US011456112B2

(12) United States Patent
Mikogami et al.

(10) Patent No.: US 11,456,112 B2
(45) Date of Patent: Sep. 27, 2022

(54) COIL COMPONENT

(71) Applicant: TDK CORPORATION, Tokyo (JP)

(72) Inventors: Tasuku Mikogami, Tokyo (JP); Shuhei Someya, Tokyo (JP); Syun Ashizawa, Tokyo (JP); Setu Tsuchida, Tsuruoka (JP)

(73) Assignee: TDK CORPORATION, Tokyo (JP)

( * ) Notice: Subject to any disclaimer, the term of this patent is extended or adjusted under 35 U.S.C. 154(b) by 636 days.

(21) Appl. No.: 16/378,960

(22) Filed: Apr. 9, 2019

(65) Prior Publication Data

US 2019/0318865 A1 Oct. 17, 2019

(30) Foreign Application Priority Data

Apr. 12, 2018 (JP) ..... 2018-076658

(51) Int. Cl.
*H01F 27/24* (2006.01)
*H01F 27/29* (2006.01)
*H01F 27/28* (2006.01)

(52) U.S. Cl.
CPC ..... *H01F 27/29* (2013.01); *H01F 27/2823* (2013.01)

(58) Field of Classification Search
USPC ..... 336/212
See application file for complete search history.

(56) References Cited

U.S. PATENT DOCUMENTS

2014/0292464 A1* 10/2014 Takagi ..... H01F 27/29 336/192
2016/0240305 A1* 8/2016 Igarashi ..... H01F 27/2828
2017/0011843 A1 1/2017 Mikogami et al.

FOREIGN PATENT DOCUMENTS

JP 2011119379 A 6/2011
JP 2016-63195 A 4/2016
JP 2017017288 A 1/2017

* cited by examiner

*Primary Examiner* — Ronald Hinson
(74) *Attorney, Agent, or Firm* — Young Law Firm, P.C.

(57) ABSTRACT

Disclosed herein is a coil component that includes a core including a winding core part extending in the x-direction and a flange part, a terminal electrode provided on the flange part, and a wire wound around the winding core part and connected to the terminal electrode. The terminal electrode does not overlap the winding core part in the y-direction. The wire includes a wound part wound around the winding core part and a drawn part drawn from the wound part, running across the winding core part in the z-direction and connected to the terminal electrode. The core has a positioning part that positions the drawn part of the wire in the y-direction.

18 Claims, 12 Drawing Sheets

COIL COMPONENT

BACKGROUND OF THE INVENTION

Field of the Invention

The present invention relates to a coil component and, more particularly, to a coil component using a drum-shaped core.

DESCRIPTION OF RELATED ART

A coil component using a drum-shaped core is widely used in electronic devices such as smartphones for the reason that it is smaller in size than a coil component using a toroidal-shaped core and can be mounted on the surface of a circuit board. The drum-shaped core has a winding core part around which wires are wound and a pair of flange parts provided at both axial end portions of the winding core part, and end portions of respective wires are connected respectively to a plurality of terminal electrodes provided on each of the flange parts. While coil winding work around the winding core part and connecting work between the wire and the terminal electrode are achieved usually by using an automatic winding machine, it is not easy to accurately connect the wires and terminal electrodes due to recent miniaturization of the coil component.

In this regard, JP 2011-119379 A proposes a method that forms a V-cut in the vicinity of the terminal electrode and inserts the wire into the V-cut so as to stabilize the positional relationship between the terminal electrode and the wire.

However, as described in JP 2017-17288 A, in a coil component having many terminal electrodes on the flange part, a terminal electrode positioned at the end portion of the flange part may be distanced from the winding core part. In this case, even when the V-cut is formed in the vicinity of the terminal electrode, the wire needs to be bent at an acute angle in the V-cut, applying stress to the wire. Particularly, in a small-sized coil component, a wire having a small diameter is used, so that application of excessive stress may cause disconnection in the worst case.

SUMMARY

It is therefore an object of the present invention to provide a coil component capable of stabilizing the positional relationship between the terminal electrode and the wire even when the terminal electrode is distanced from the winding core part.

A coil component according to the present invention includes: a core including a winding core part extending in a first direction, a first flange part provided at one axial end of the winding core part, and a second flange part provided at other axial end of the winding core part; a plurality of terminal electrodes provided on the first flange part so as to be arranged in a second direction perpendicular to the first direction; a plurality of terminal electrodes provided on the second flange part so as to be arranged in the second direction; and a plurality of wires wound around the winding core part such that one end of each wire is connected to any one of the plurality of terminal electrodes provided on the first flange part and other end of each wire is connected to any one of the plurality of terminal electrodes provided on the second flange part. The plurality of terminal electrodes provided on the first flange part include a first terminal electrode whose position in the second direction does not overlap the winding core part, and the plurality of terminal electrodes provided on the second flange part include a second terminal electrode whose position in the second direction does not overlap the winding core part. The plurality of wires include first and second wires connected to the first and second terminal electrodes, respectively. Each of the first and second wires includes a wound part wound around the winding core part and drawn part drawn from the wound part, running across the winding core part in a third direction perpendicular to the first and second directions and connected to one of the first and second terminal electrodes. The core has a first positioning part that positions the drawn part of the first wire in the second direction and a second positioning part that positions the drawn part of the second wire in the second direction.

According to the present invention, the core has the first and second positioning parts, whereby the positional relationship between a terminal electrode distanced from the winding core part and the wire can be stabilized.

In the present invention, the first positioning part may be a groove or a step provided in the first flange part and extending in the third direction, and the second positioning part may be a groove or a step provided in the second flange part and extending in the third direction. With this configuration, the wire is bent more gently than when a V-cut is formed in the vicinity of the terminal electrode, making it possible to relieve stress applied to the wire.

In the present invention, the groove or step may have an inclined surface making the depth thereof in the first direction increase toward the first and second terminal electrodes. This can further relieve the stress applied to the wire.

In the present invention, the first positioning part may be formed over the entire length area of the first flange part in the third direction, and the second positioning part may be formed over the entire length area of the second flange part in the third direction. This facilitates production of the core using a die.

In the present invention, the first positioning part may have a length in the third direction shorter than the length of the first flange part in the third direction and have a shape in which the end portion thereof on the first terminal electrode side is opened, and the second positioning part may have a length in the third direction shorter than the length of the second flange part in the third direction and have a shape in which the end portion thereof on the second terminal electrode side is opened. With this configuration, the volume of the core can be ensured to thereby obtain high magnetic characteristics.

In the present invention, each of the first and second positioning parts partially overlaps the winding core part in the third direction. With this configuration, the wire is bent gently, so that the stress applied to the wire can be relieved.

In the present invention, the first and second flange parts may each include a first area whose position in the first direction overlaps the plurality of terminal electrodes and a second area positioned between the first area and the winding core part and whose position in the first direction does not overlap the plurality of terminal electrodes. A step may be formed between the end portions of the respective first and second areas in the third direction, making the second region be lower in position than the first area in the third direction. Both the first and second positioning parts may be formed in the second area. This can relieve the stress applied to the wire.

In the present invention, the first positioning part may be a projection provided on the first flange part, and the second positioning part may be a projection provided on the second flange part. With this configuration, it is possible to stabilize the positional relationship between a terminal electrode distanced from the winding core part and the wire without reducing the volume of the core.

As described above, according to the present invention, it is possible to stabilize the positional relationship between the terminal electrode and the wire even when the terminal electrode is distanced from the winding core part.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

First Embodiment

Figure 1:
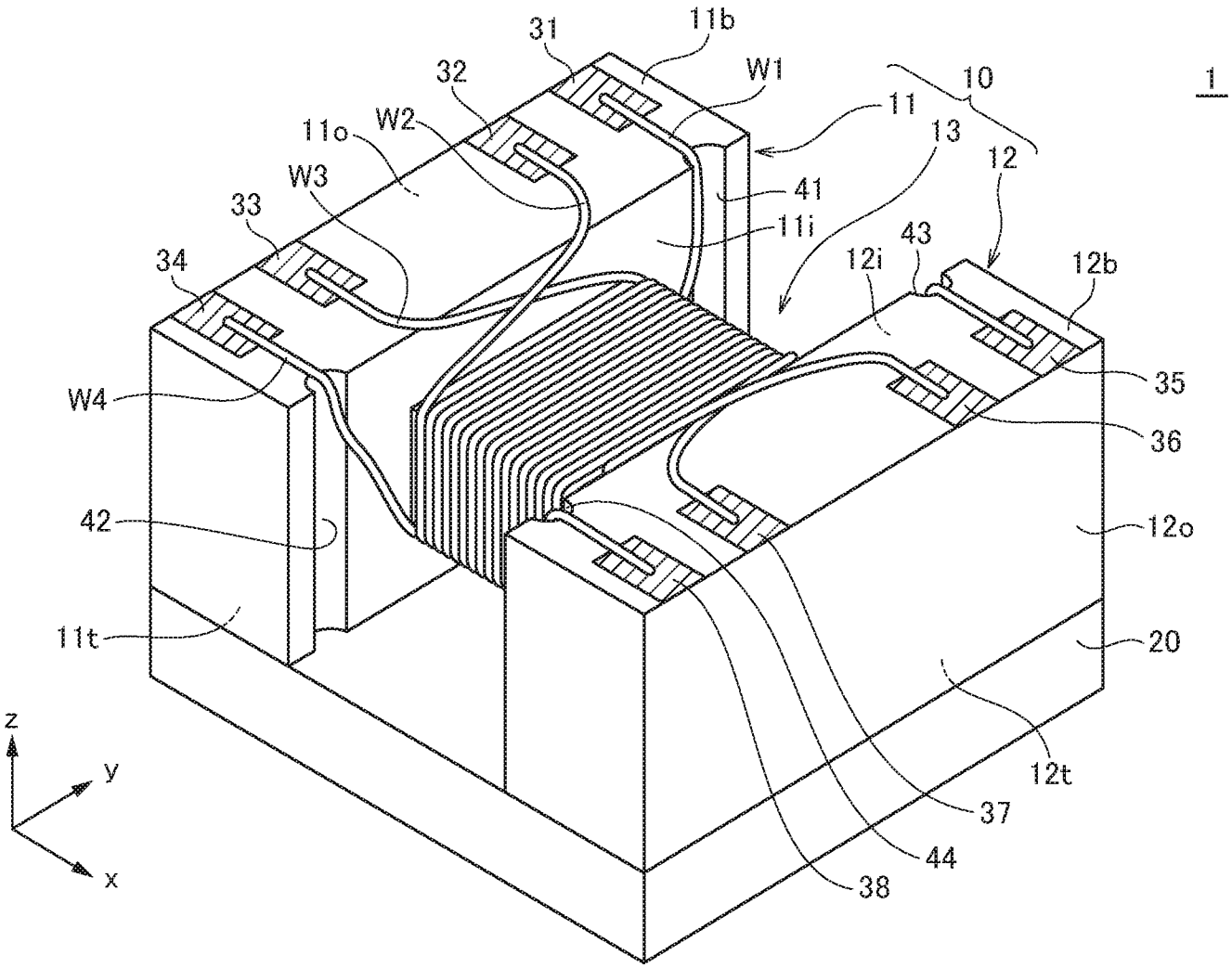
FIG. 1 is a schematic perspective view illustrating the outer structure of a coil component according to a first embodiment of the present invention.

FIG. 1 is a schematic perspective view illustrating the outer structure of a coil component 1 according to the first embodiment of the present invention.

The coil component 1 according to the first embodiment is a surface-mount type pulse transformer and has a drum-shaped core 10, a plate-like core 20 bonded to the core 10, and four wires W1 to W4 wound around a winding core part 13 of the core 10 as illustrated in FIG. 1.

However, the coil component according to the present invention is not limited to the pulse transformer, but may be a transformer component of another type such as a balun transformer or a boosting transformer, or a filter component such as a common mode choke coil.

The cores 10 and 20 are each made of a magnetic material having comparatively high permeability, such as a sintered body of an Ni—Zn based ferrite or an Mn—Zn based ferrite. In general, a magnetic material having high permeability such as the Mn—Zn based ferrite is low in specific resistance and thus has conductivity.

The drum-shaped core 10 integrally has a rod-like winding core part 13 whose axis extends in the x-direction and first and second flange parts 11 and 12 provided at both ends of the winding core part 13 in the x-direction. The first flange part 11 has an inner surface 11*i* and an outer surface 11*o* which constitute the yz plane and a mounting surface 11*b* and a bonding surface 11*t* which constitute the xy plane. Similarly, the second flange part 12 has an inner surface 12*i* and an outer surface 12*o* which constitute the yz plane and a mounting surface 12*b* and a bonding surface 12*t* which constitute the xy plane.

The coil component 1 is a chip component surface-mounted on a printed circuit board when used and is mounted with the mounting surfaces 11*b* and 12*b* of the flange parts 11 and 12 facing the printed circuit board. The plate-like core 20 is fixed to the bonding surfaces 11*t* and 12*t* of the flange parts 11 and 12 with an adhesive. A closed magnetic loop is formed by the thus configured drum-shaped core 10 and plate-like core 20.

Four terminal electrodes 31 to 34 are arranged in the y-direction on the mounting surface 11*b* of the first flange part 11, and four terminal electrodes 35 to 38 are arranged in the y-direction on the mounting surface 12*b* of the second flange part 12. The terminal electrodes 31 to 34 may be formed over the mounting surface 11*b* and outer surface 11*o*, and the terminal electrodes 35 to 38 may be formed over the mounting surface 12*b* and outer surface 12*o*. Further, the terminal electrodes 31 to 38 may be formed not only on the mounting surfaces 11*b* and 12*b*, but also on their opposing bonding surfaces 11*t* and 12*t*. The terminal electrodes 31 to 38 may each be a conductive film applied to the corresponding flange part 11 or 12 or may each be a terminal fitting. Of the terminal electrodes 31 to 38, the terminal electrodes 31, 34, 35, and 38 each positioned at the end portion in the y-direction do not overlap the winding core part 13 in the y-direction; the remaining terminal electrodes 32, 33, 36, and 37 overlap the winding core part 13 in the y-direction.

As illustrated in FIG. 1, the four wires W1 to W4 are wound around the winding core part 13. One ends of the wires W1 to W4 are connected to their respective terminal electrodes 31 to 34, and the other ends thereof are connected to their respective terminal electrodes 35 to 38. Although not particularly limited, the wire connection can be achieved by thermocompression bonding or laser joining.

Although not particularly limited, the wire W1 is connected to the terminal electrodes 31 and 36, and the winding direction thereof is, for example, clockwise. The wire W2 is connected to the terminal electrodes 32 and 35, and the winding direction thereof is, for example, counterclockwise. The wire W3 is connected to the terminal electrodes 33 and 38, and the winding direction thereof is, for example, clockwise. The wire W4 is connected to the terminal electrodes 34 and 37, and the winding direction thereof is, for example, counterclockwise. With this configuration, for example, the terminal electrodes 31 and 32 can be used as the primary side input/output terminal of the pulse transformer, the terminal electrodes 37 and 38 can be used as the secondary side input/output terminal of the pulse transformer, the terminal electrodes 35 and can be used as the primary center tap of the pulse transformer, and the terminal electrodes 33 and 34 can be used as the secondary center tap of the pulse transformer. The terminal electrodes 35 and 36 constituting the primary center tap may be combined into a single terminal electrode. Similarly, the terminal electrodes 33 and 34 constituting the secondary center tap may be combined into a single terminal electrode.

In the coil component 1 according to the present embodiment, grooves 41 and 42 are formed in the inner surface 11*i* of the flange part 11, and grooves 43 and 44 are formed in the inner surface 12*i* of the second flange part 12. The grooves 41 and 42 are formed at substantially the same position in the y-direction as the terminal electrodes 31 and 34, respectively and each constitute a first positioning part for positioning a drawn part of the wire (W1 and W4) in the y-direction. Similarly, the grooves 43 and 44 are formed at substantially the same position in the y-direction as the terminal electrodes 35 and 38, respectively and each constitute a second positioning part for positioning a drawn part of the wire (W2 and W3) in the y-direction. The drawn parts of the wires W1 to W4 refer to portions drawn from the wound part of the wire wound around the winding core part 13, running across the winding core part 13 in the z-direction, and connected to the terminal electrodes 31, 34, 35, and 38, respectively.

In the present embodiment, the grooves 41 and 42 are formed over the entire length area of the flange part 11 in the z-direction, and the grooves 43 and 44 are formed over the entire length area of the flange part 12 in the z-direction. Thus, when the core 10 having the grooves 41 to 44 are produced using a die, the shape of the die can be simplified, and removal of the core 10 from the die can be facilitated.

Figure 2:
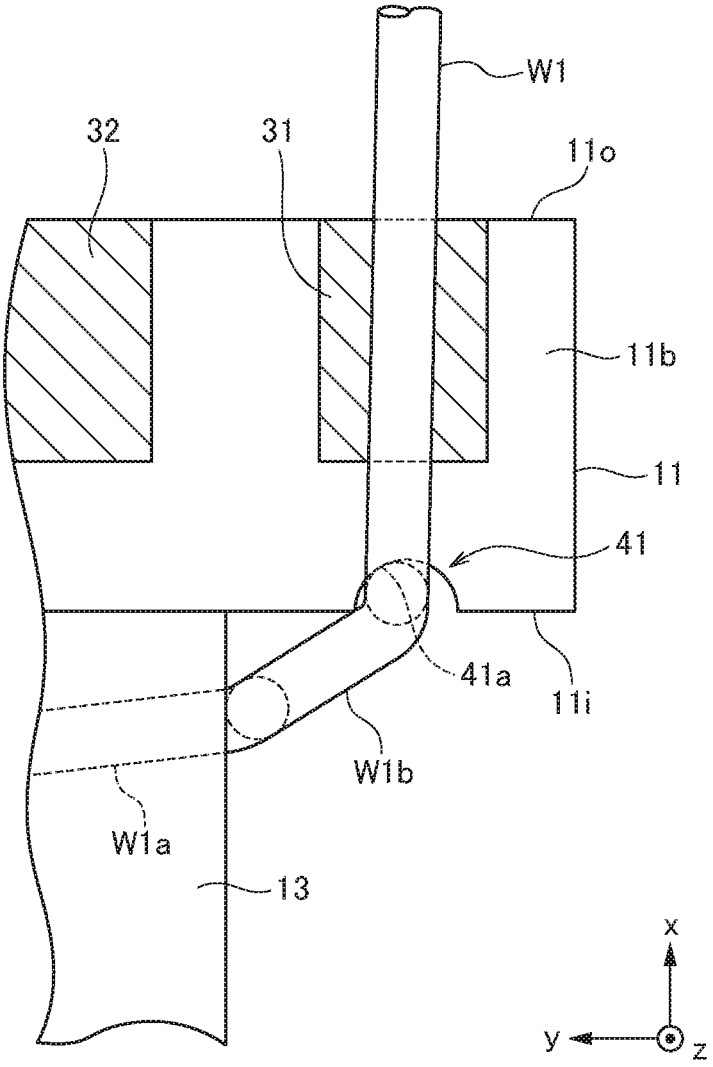
FIG. 2 is an enlarged view illustrating a portion around the groove and terminal electrode as viewed in the z-direction.
Figure 3:
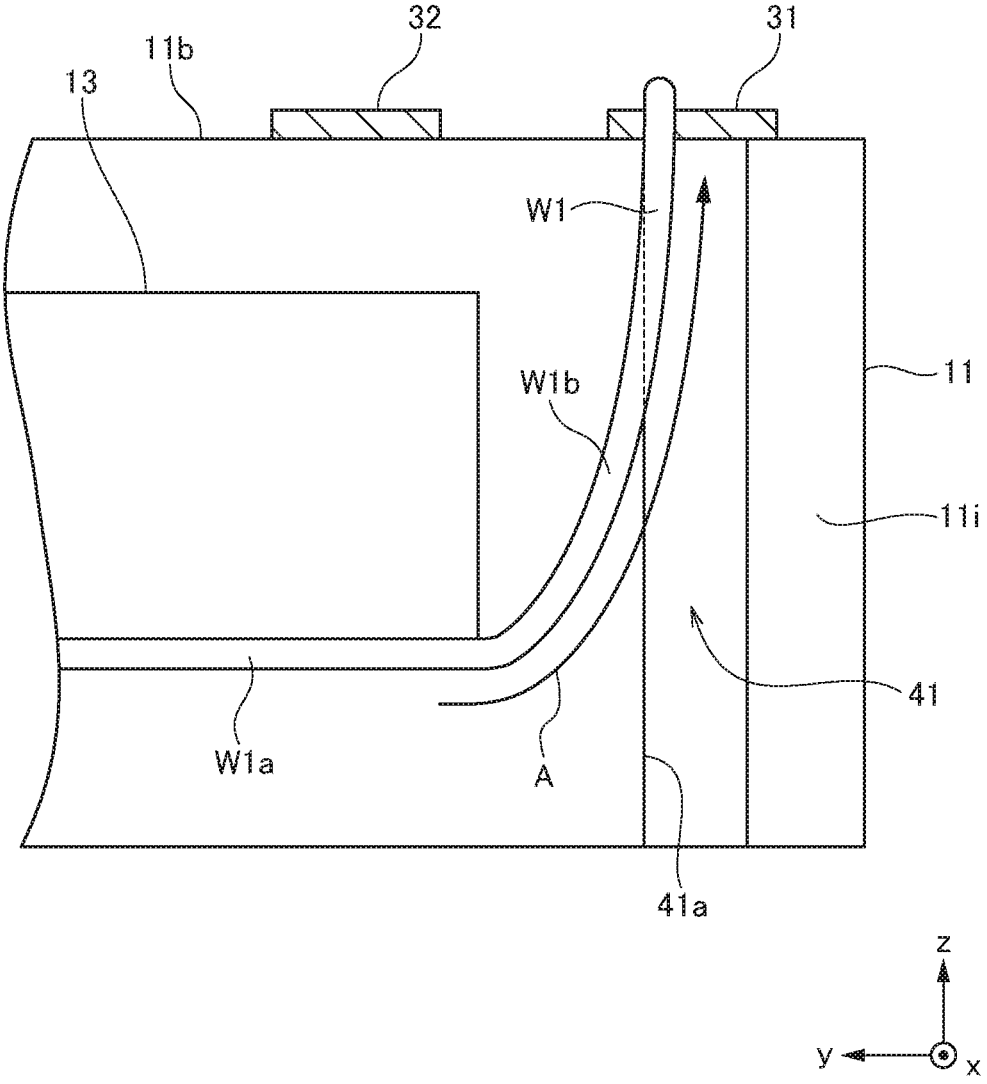
FIG. 3 is an enlarged view illustrating a portion around the groove and terminal electrode as viewed in the x-direction.

FIG. 2 is an enlarged view illustrating a portion around the groove 41 and terminal electrode 31 as viewed in the z-direction. FIG. 3 is an enlarged view illustrating a portion around the groove 41 and terminal electrode 31 as viewed in the x-direction.

As illustrated in FIGS. 2 and 3, the wire W1 has a wound part W1*a* wound around the winding core part 13 and a drawn part W1*b* drawn from the wound part W1*a*, running across the winding core part 13 in the z-direction, and connected to the terminal electrode 31. In the present embodiment, the drawn part W1*b* of the wire W1 is positioned in the y-direction by an inner wall surface 41*a* of the groove 41. The terminal electrode 31 does not overlap the winding core part 13 in the y-direction but exists at a position distanced from the winding core part 13 in the y-direction, so that the drawn part W1*b* of the wire W1 is connected to the terminal electrode 31 while the position thereof being shifted in the y-direction. At this time, the drawn part W1*b* of the wire W1 is positioned in the y-direction by the inner wall surface 41*a* of the groove 41, so that after being detached from the groove 41, the wire W1 can be drawn substantially straight in the x-direction with respect to the terminal electrode 31. FIG. 2 illustrates the position of the wire W1 when being connected to the terminal electrode 31, in which the wire W1 extends in the x-direction beyond the terminal electrode 31. In this state, the wire W1 is subjected to, e.g., thermocompression bonding to the terminal electrode 31 from above, and an unnecessary part of the wire W1 is cut off, whereby connection of the wire W1 to the terminal electrode 31 is achieved.

Figure 4:
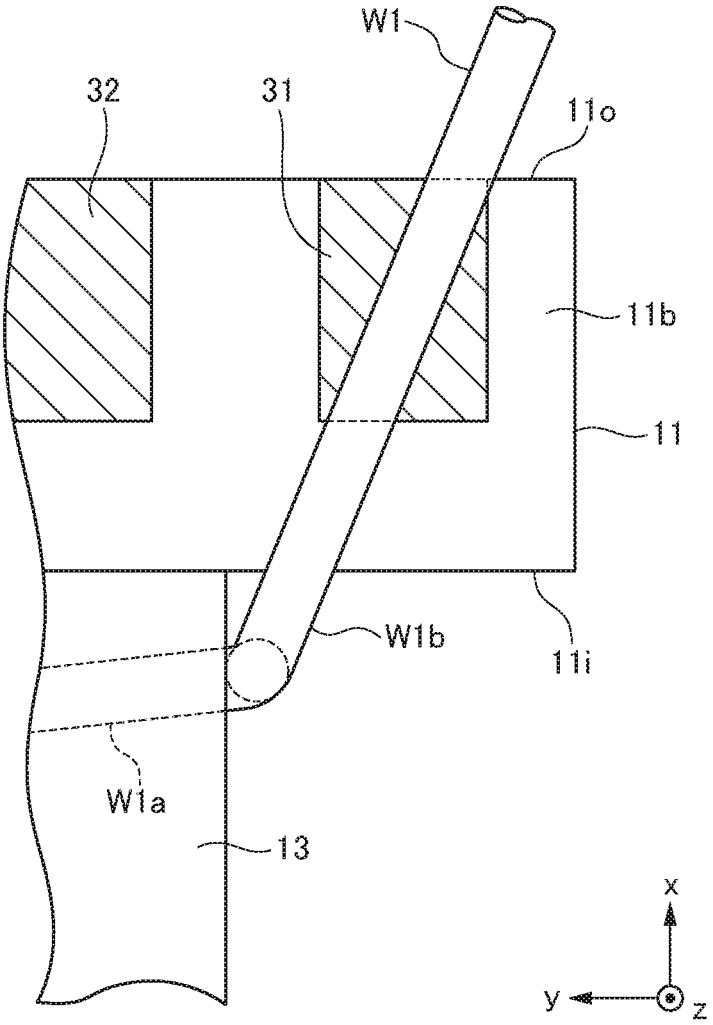
FIG. 4 is a diagram for explaining a problem may occur in a first comparative example.

On the other hand, when the groove 41 does not exist as illustrated in FIG. 4, which is a first comparative example, the drawn part W1*b* of the wire W1 cannot be positioned in the y-direction and thus cannot be drawn straight in the x-direction with respect to the terminal electrode 31. As a result, the drawn part W1*b* is drawn obliquely. The wire connection in such a condition causes connection failure and defect in appearance.

Figure 5:
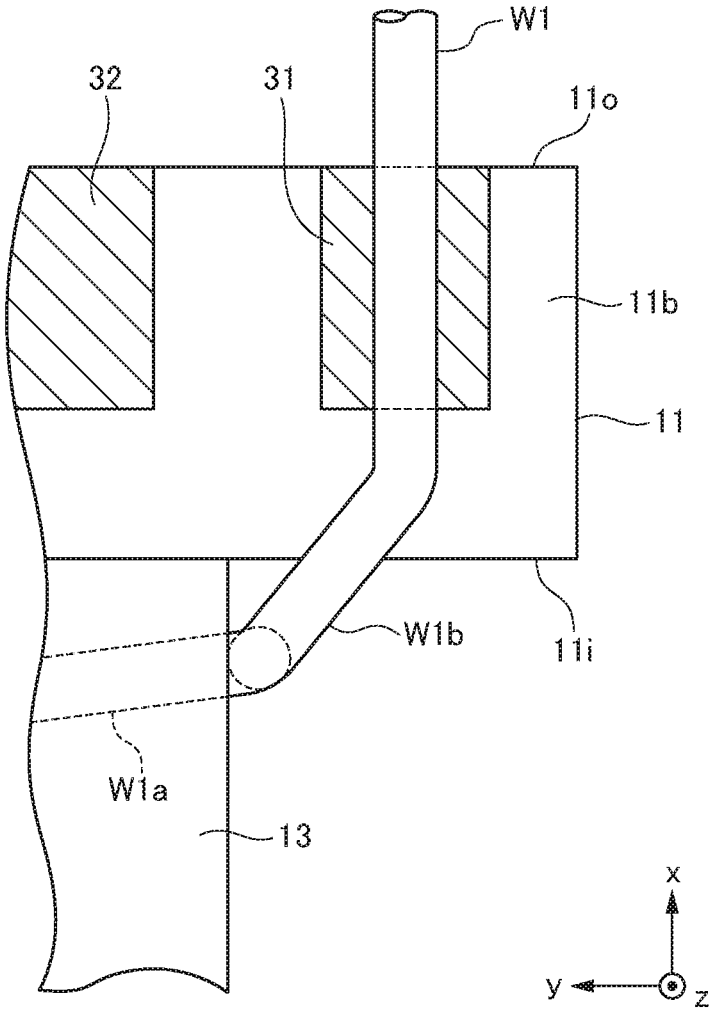
FIG. 5 is a diagram for explaining a problem may occur in a second comparative example.

The above problem can be solved by bending the wire W1 in the vicinity of the terminal electrode 31 as illustrated in FIG. 5, which is a second comparative example; in this case, however, stress is applied to the wire W1 due to the bending. Further, when the core 10 has a very small size, it is not easy to properly bend the wire W1 in the vicinity of the terminal electrode 31, and there is still the problem of connection failure.

On the other hand, in the present embodiment, the drawn part W1*b* of the wire W1 shifted in position in the y-direction is positioned in the y-direction by the inner wall surface 41*a* of the groove 41, so that, as described above, after being detached from the groove 41, the wire W1 can be drawn substantially straight in the x-direction with respect to the terminal electrode 31. This can prevent connection failure or defect in appearance and can relieve the stress applied to the wire W1.

Figure 6:
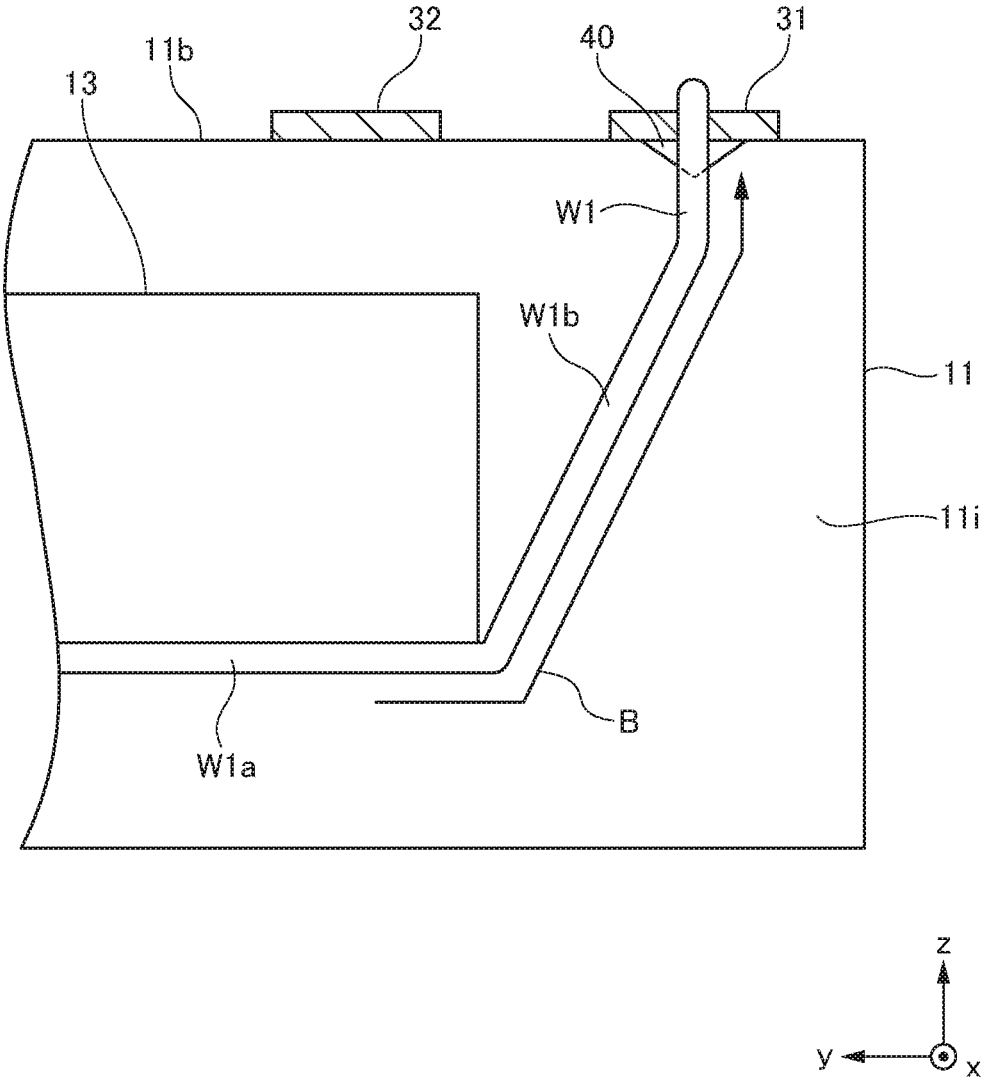
FIG. 6 is a diagram for explaining a problem may occur in a third comparative example.

Further, as illustrated in FIG. 6, which is a third comparative example, it can be considered a method of forming a V-cut 40 in the vicinity of the terminal electrode 31 for fixing the drawn part W1*b* of the wire W1 to the V-cut 40. In this case, as denoted by the arrow B, the wire W1 is strongly bent between the wound part W1*a* and the drawn part W1*b* and also at the V-cut 40. On the other hand, in the present embodiment, as denoted by the arrow A of FIG. 3, the wire W1 is gently bent, thus making it possible to relieve the stress applied to the wire W1. This effect is obtained because the groove 41 not only exists in the vicinity of the terminal electrode 31 but also extends in the z-direction from the vicinity of the terminal electrode.

The same applies to the other wires W2 to W4. That is, the wires W2, W3, and W4 are positioned by their corresponding grooves 43, 44, and 42, respectively and connected to their corresponding terminal electrodes 35, 38, and 34, respectively.

As described above, in the coil component 1 according to the present embodiment, the grooves 41 and 42 are formed in the inner surface 11*i* of the flange part 11, and the grooves 43 and 44 are formed in the inner surface 12*i* of the flange part 12. The wires W1 to W4 are positioned in the y-direction by their corresponding grooves 41 to 44, respectively, so that it is possible to stabilize the positional relationship between the terminal electrodes 31 to 38 and the wires W1 to W4 while relieving the stress applied to the wires W1 to W4. In addition, in the present embodiment, the grooves 41 and 42 are formed over the entire length area of the flange part 11 in the z-direction, and the grooves 43 and 44 are formed over the entire length area of the flange part 12 in the z-direction. Thus, when the core 10 having the grooves 41 to 44 are produced using a die, the shape of the die can be simplified, and removal of the core 10 from the die can be facilitated.

Second Embodiment

Figure 7:
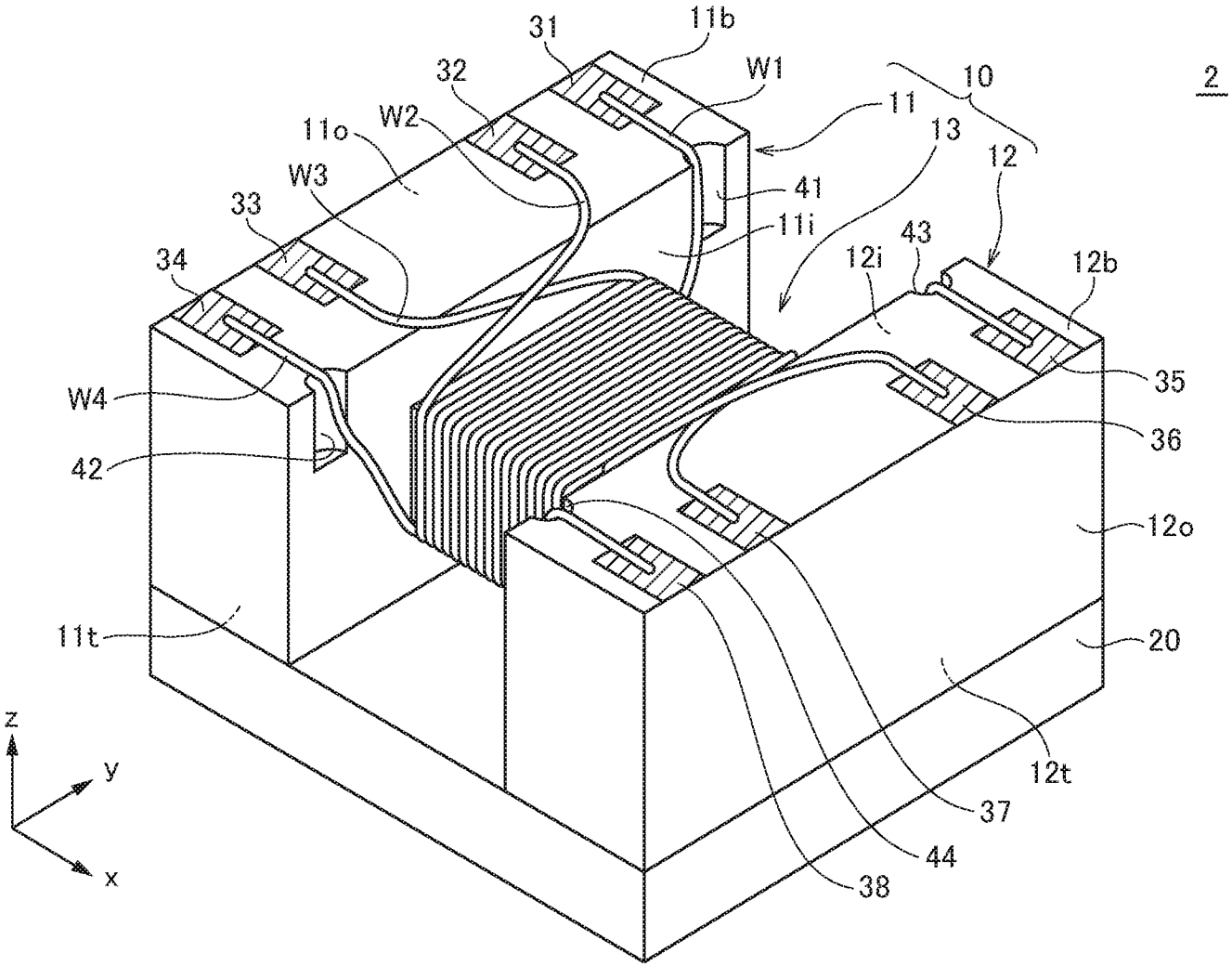
FIG. 7 is a schematic perspective view illustrating the outer structure of a coil component according to a second embodiment of the present invention.

FIG. 7 is a schematic perspective view illustrating the outer structure of a coil component 2 according to the second embodiment of the present invention.

As illustrated in FIG. 7, the coil component 2 according to the second embodiment differs from the coil component 1 according to the first embodiment in that the length of each of the grooves 41 to 44 in the z-direction is shorter than the length of the flange part (11, 12) in the z-direction. Other configurations are basically the same as those of the coil component 1 according to the first embodiment, so the same reference numerals are given to the same elements, and overlapping description will be omitted.

In the present embodiment, one end portion of each of the grooves 41 to 44 in the z-direction is opened at the side of the mounting surface (11*b*, 12*b*), i.e., the side of the terminal electrode (31 to 38), while the other end portion thereof in the z-direction does not reach the bonding surface (11*t*, 12*t*) but is terminated halfway. While the specific length in the z-direction of each of the grooves 41 to 44 is not particularly limited, the stress applied to the wires W1 to W4 becomes smaller as the groove becomes deeper, whereas the volume of the core 10 is increased as the groove becomes shallower. In order to ensure a sufficient volume of the core 10 while effectively relieving the stress applied to the wires W1 to W4, the grooves 41 to 44 are preferably made shallow within a range that the grooves overlap the winding core part 13 in the z-direction.

As exemplified in the present embodiment, in the present invention, the grooves 41 to 44 each constituting the positioning part need not be formed over the entire length area of the flange part (11, 12) in the z-direction.

Third Embodiment

Figure 8:
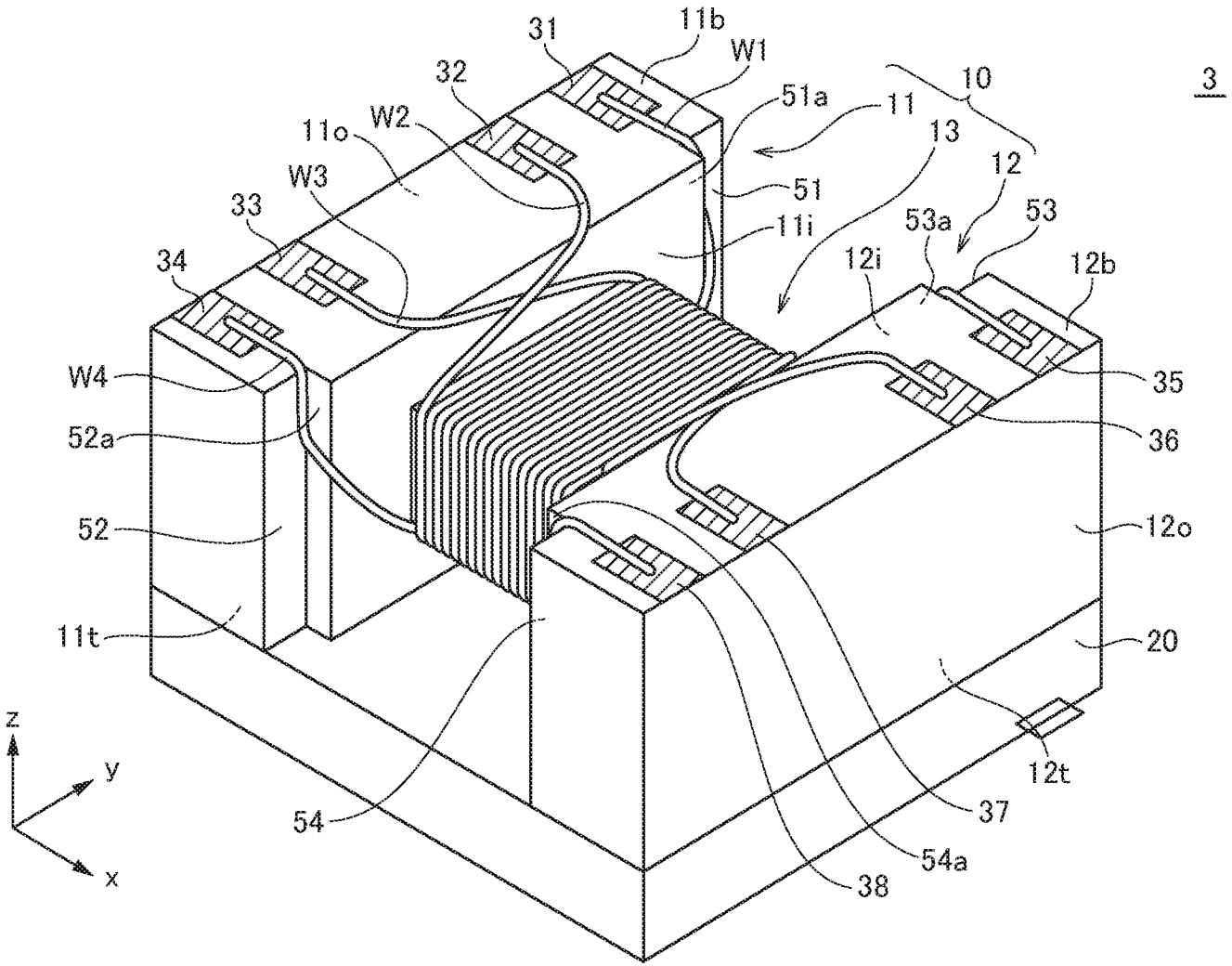
FIG. 8 is a schematic perspective view illustrating the outer structure of a coil component according to a third embodiment of the present invention.

FIG. 8 is a schematic perspective view illustrating the outer structure of a coil component 3 according to the third embodiment of the present invention.

As illustrated in FIG. 8, the coil component 3 according to the third embodiment differs from the coil component 1 according to the first embodiment in that steps 51 to 54 are formed in the flange parts 11 and 12 in place of the grooves 41 to 44. Other configurations are basically the same as those of the coil component 1 according to the first embodiment, so the same reference numerals are given to the same elements, and overlapping description will be omitted.

The steps 51 to 54 are each a portion where the thickness in the x-direction is reduced at the end portion of the flange part (11, 12) in the y-direction and each equivalent to a shape illustrated in FIG. 1 in which the outer wall surface of the groove (41 to 44) is opened. In this case, the drawn parts of the wires W1 to W4 can be positioned on step surfaces 51*a* to 54*a* of the steps 51 to 54, respectively.

As exemplified in the present embodiment, in the present invention, the positioning part need not be constituted by the groove (41 to 44), but may be constituted by the step (51 to 54).

Fourth Embodiment

Figure 9:
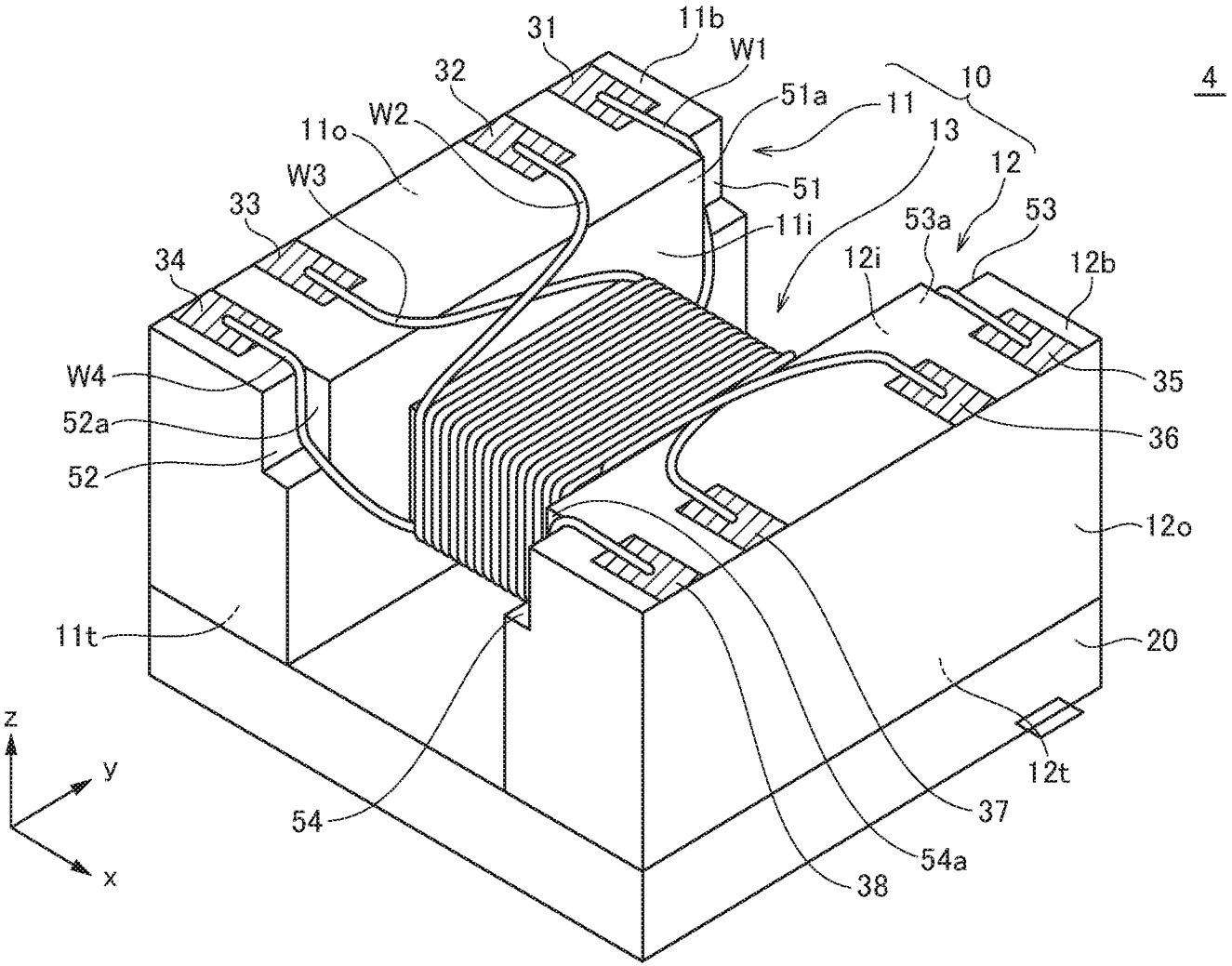
FIG. 9 is a schematic perspective view illustrating the outer structure of a coil component according to a fourth embodiment of the present invention.

FIG. 9 is a schematic perspective view illustrating the outer structure of a coil component 4 according to the fourth embodiment of the present invention.

As illustrated in FIG. 9, the coil component 4 according to the fourth embodiment differs from the coil component 3 according to the third embodiment in that the length of each of the steps 51 to 54 in the z-direction is shorter than the length of the flange part (11, 12) in the z-direction. Other configurations are basically the same as those of the coil component 3 according to the third embodiment, so the same reference numerals are given to the same elements, and overlapping description will be omitted.

In the present embodiment, one end portion of each of the steps 51 to 54 in the z-direction is opened at the side of the mounting surface (11*b*, 12*b*), i.e., the side of the terminal electrode (31 to 38), while the other end portion thereof in the z-direction does not reach the bonding surface (11*t*, 12*t*) but is terminated halfway. While the specific length of each of the steps 51 to 54 is not particularly limited, the stress applied to the wires W1 to W4 becomes smaller as the step becomes deeper, whereas the volume of the core 10 is increased as the step becomes shallower. In order to ensure a sufficient volume of the core 10 while effectively relieving the stress applied to the wires W1 to W4, the steps 51 to 54 are preferably made shallow within a range that the steps overlap the winding core part 13 in the z-direction.

As exemplified in the present embodiment, in the present invention, the steps 51 to 54 each constituting the positioning part need not be formed over the entire length area of the flange part (11, 12) in the z-direction.

Fifth Embodiment

Figure 10:
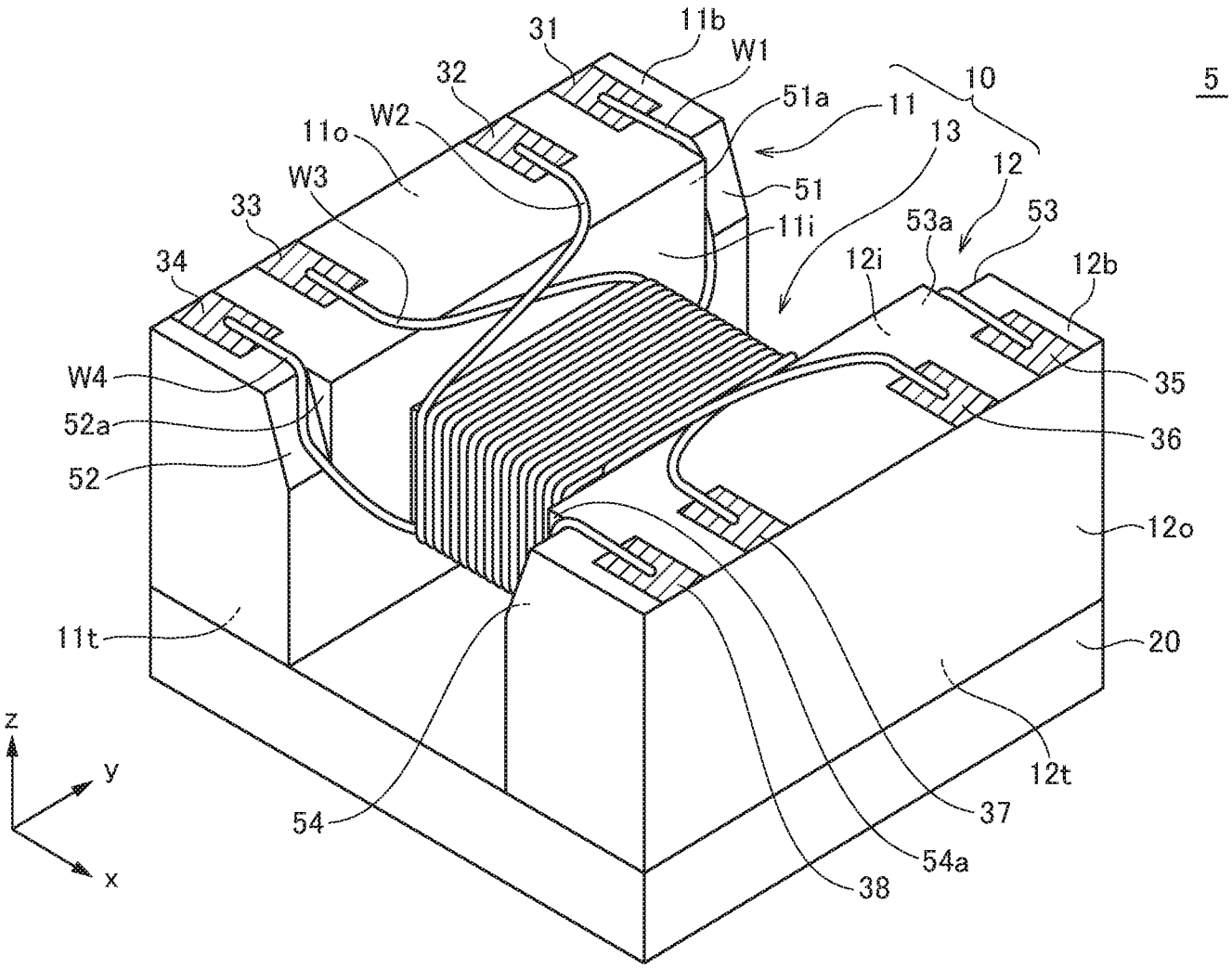
FIG. 10 is a schematic perspective view illustrating the outer structure of a coil component according to a fifth embodiment of the present invention.

FIG. 10 is a schematic perspective view illustrating the outer structure of a coil component 5 according to the fifth embodiment of the present invention.

As illustrated in FIG. 10, the coil component 5 according to the fifth embodiment differs from the coil component 4 according to the fourth embodiment in that the positioning part has an inclined surface making the depth of each of the steps 51 to 54 in the x-direction increase toward the mounting surface (11*b*, 12*b*), i.e., terminal electrode (31 to 38). Other configurations are basically the same as those of the coil component 4 according to the fourth embodiment, so the same reference numerals are given to the same elements, and overlapping description will be omitted.

According to the present embodiment, the stress applied to the wires W1 to W4 can be further relieved, and the volume of the core 10 can be increased more than in the coil component 4 according to the fourth embodiment.

Thus, higher magnetic characteristics can be obtained.

Sixth Embodiment

Figure 11:
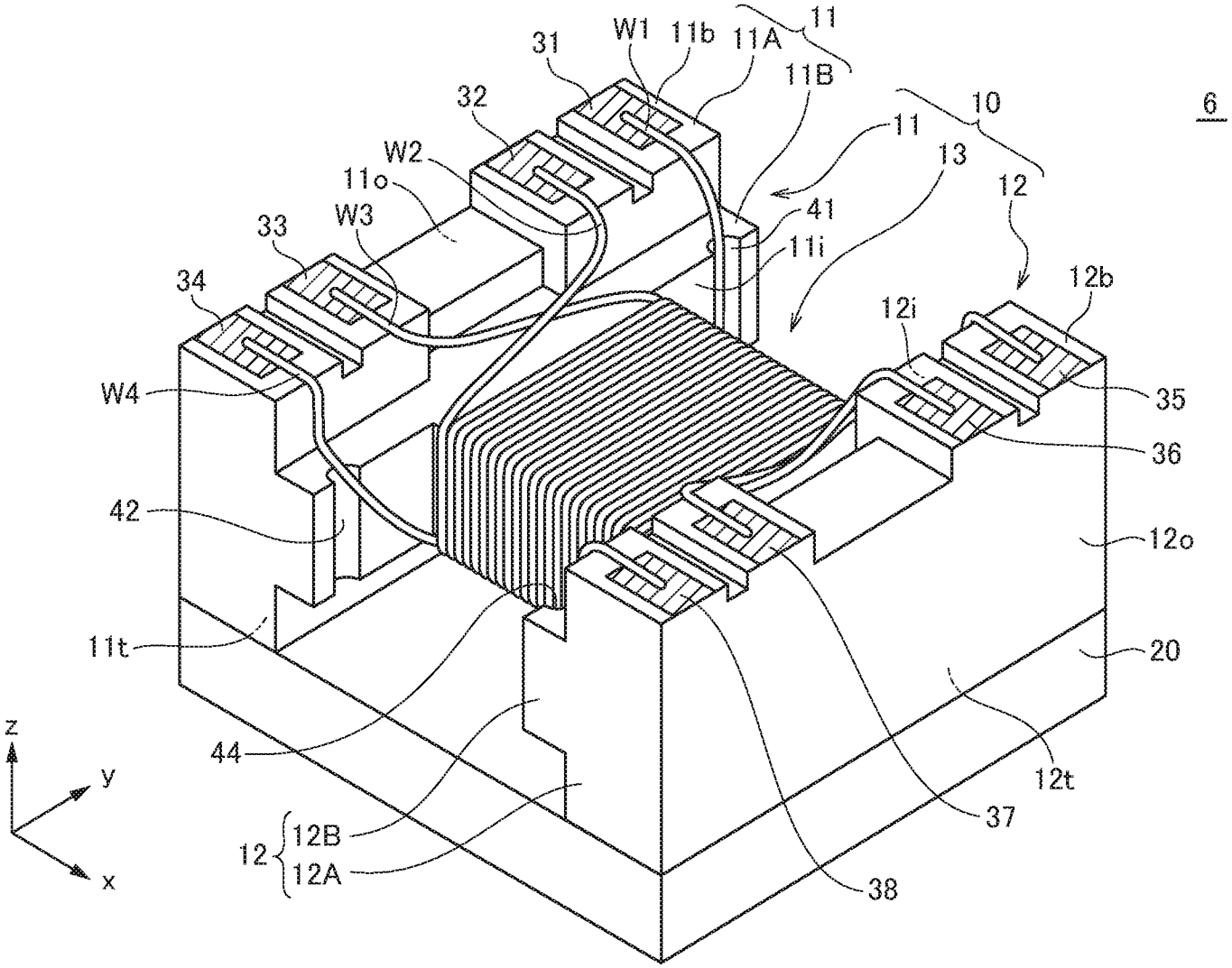
FIG. 11 is a schematic perspective view illustrating the outer structure of a coil component according to a sixth embodiment of the present invention.

FIG. 11 is a schematic perspective view illustrating the outer structure of a coil component 6 according to the sixth embodiment of the present invention.

As illustrated in FIG. 11, the coil component 6 according to the sixth embodiment differs from the coil component 1 according to the first embodiment in that the flange part 11 is constituted of first and second areas 11A and 11B, the flange part 12 is constituted of first and second areas 12A and 12B, the grooves 41 and 42 are formed in the second area 11B of the flange part 11, and grooves 43 and 44 are formed in the second area 12B of the flange part 12. Other configurations are basically the same as those of the coil component 1 according to the first embodiment, so the same reference numerals are given to the same elements, and overlapping description will be omitted. In FIG. 11, the groove 43 is not visible.

The first area 11A is an area whose position in the x-direction overlaps the terminal electrodes 31 to 34, and the second area 11B is an area whose position in the x-direction does not overlap the terminal electrodes 31 to 34. Similarly, the first area 12A is an area whose position in the x-direction overlaps the terminal electrodes 35 to 38, and the second area 12B is an area whose position in the x-direction does not overlap the terminal electrodes 35 to 38. The first and second areas 11A and 11B form a step, and the position of the end portion of the second area 11B in the z-direction is lower than that of the first area 11A. Similarly, the first and second areas 12A and 12B form a step, and the position of the end portion of the second area 12B in the z-direction is lower than that of the first area 12A.

As exemplified in the present embodiment, when the flange part includes the first and second areas, it is possible to relieve the stress applied to the wires W1 to W4 by forming the grooves 41 to 44 (or steps 51 to 54) in the second area.

Seventh Embodiment

Figure 12:
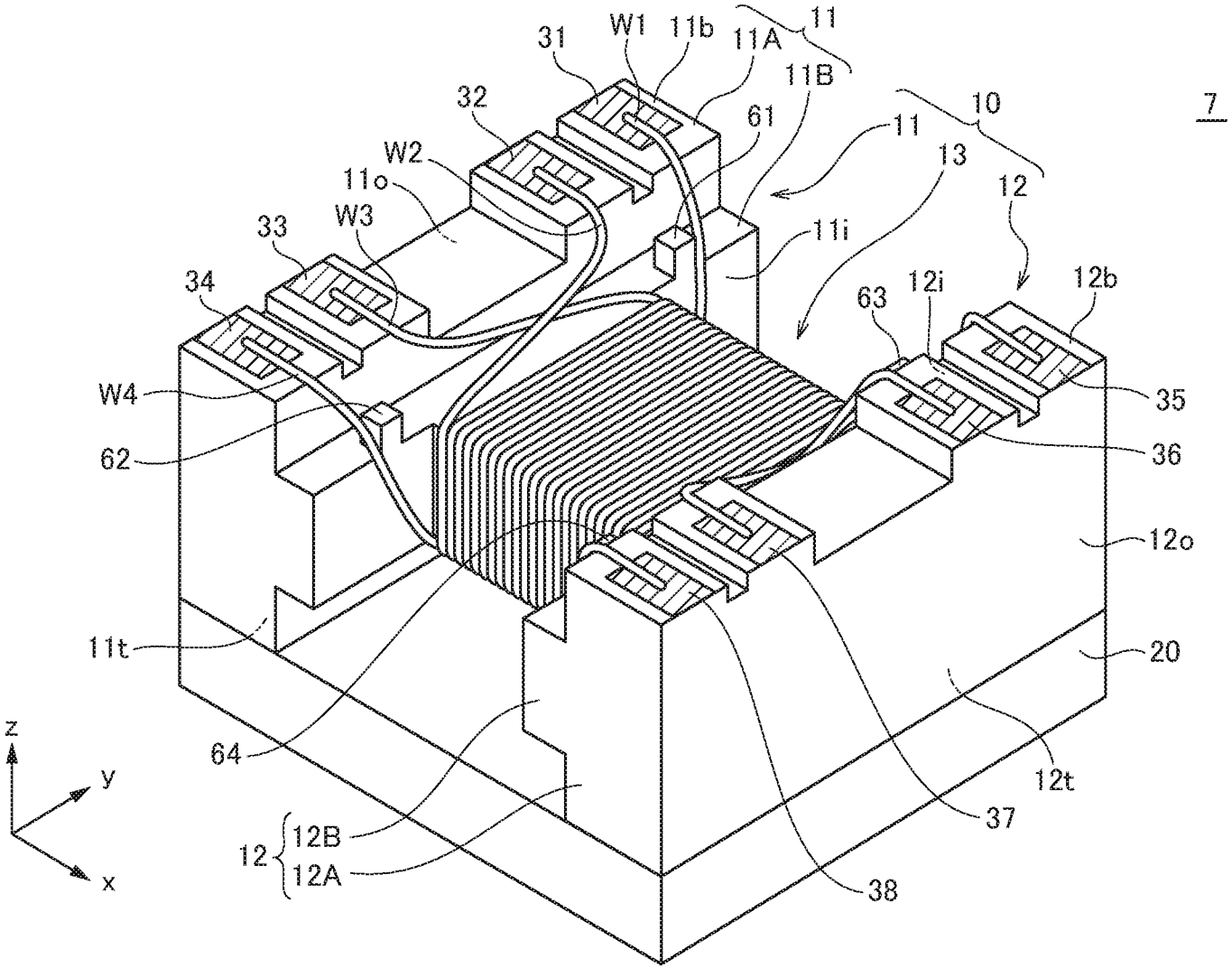
FIG. 12 is a schematic perspective view illustrating the outer structure of a coil component according to a seventh embodiment of the present invention.

FIG. 12 is a schematic perspective view illustrating the outer structure of a coil component 7 according to the seventh embodiment of the present invention.

As illustrated in FIG. 12, the coil component 7 according to the seventh embodiment differs from the coil component 6 according to the sixth embodiment in that projections 61 and 62 are formed on the second area 11B of the flange part 11 in place of the grooves 41 and 42, and projections 63 and 64 are formed on the second area 12B of the flange part 12 in place of the grooves 43 and 44. Other configurations are basically the same as those of the coil component 6 according to the sixth embodiment, so the same reference numerals are given to the same elements, and overlapping description will be omitted.

The projections 61 and 62 have outer surfaces whose y-direction positions are substantially the same as those of the terminal electrodes 31 and 34 and constitute first positioning parts that position the drawn parts of the respective wires W1 and W4 in the y-direction. Similarly, the projections 63 and 64 have outer surfaces whose y-direction positions are substantially the same as those of the terminal electrodes 35 and 38 and constitute second positioning parts that position the drawn parts of the respective wires W2 and W3 in the y-direction.

As exemplified in the present embodiment, in the present invention, the positioning part need not be the groove or step, but may be the projection.

It is apparent that the present invention is not limited to the above embodiments, but may be modified and changed without departing from the scope and spirit of the invention.

What is claimed is:

1. A coil component comprising:

a core including:

a winding core part extending in a first direction;

a first flange part provided at one axial end of the winding core part; and a second flange part provided at other axial end of the winding core part;

a plurality of terminal electrodes provided on the first flange part so as to be arranged in a second direction perpendicular to the first direction;

a plurality of terminal electrodes provided on the second flange part so as to be arranged in the second direction; and a plurality of wires wound around the winding core part such that one end of each wire is connected to any one of the plurality of terminal electrodes provided on the first flange part and other end of each wire is connected to any one of the plurality of terminal electrodes provided on the second flange part, wherein the plurality of terminal electrodes provided on the first flange part include a first terminal electrode whose position in the second direction does not overlap the winding core part, wherein the plurality of terminal electrodes provided on the second flange part include a second terminal electrode whose position in the second direction does not overlap the winding core part, wherein the plurality of wires include first and second wires connected to the first and second terminal electrodes, respectively, wherein each of the first and second wires includes a wound part wound around the winding core part and drawn part drawn from the wound part, running across the winding core part in a third direction perpendicular to the first and second directions and connected to one of the first and second terminal electrodes, wherein the core has a first positioning part that positions the drawn part of the first wire in the second direction and a second positioning part that positions the drawn part of the second wire in the second direction, wherein the first positioning part is a first groove provided in the first flange part and having a first inner sidewall positioned at the winding core part side and a first outer sidewall positioned opposite to the first inner sidewall in the second direction, wherein the second positioning part is a second groove provided in the second flange part and having a second inner sidewall positioned at the winding core part side and a second outer sidewall positioned opposite to the second inner sidewall in the second direction, wherein the drawn part of the first wire contacts a part of the first inner sidewall without contacting the first outer sidewall, and wherein the drawn part of the second wire contacts a part of the second inner sidewall without contacting the second outer sidewall.

2. The coil component as claimed in claim 1, wherein the first positioning part is formed over an entire length area of the first flange part in the third direction, and wherein the second positioning part is formed over an entire length area of the second flange part in the third direction.

3. The coil component as claimed in claim 1, wherein the first groove extends in the third direction, and wherein the second groove extends in the third direction.

4. The coil component as claimed in claim 3, wherein the first groove has an inclined surface making a depth thereof in the first direction increase toward the first and second terminal electrodes and wherein the second groove has an inclined surface making a depth thereof in the first direction increase toward the first and second terminal electrodes.

5. The coil component as claimed in claim 1, wherein the first positioning part has a length in the third direction shorter than a length of the first flange part in the third direction and have a shape in which an end portion thereof on the first terminal electrode side is opened, and wherein the second positioning part has a length in the third direction shorter than a length of the second flange part in the third direction and have a shape in which an end portion thereof on the second terminal electrode side is opened.

6. The coil component as claimed in claim 5, wherein each of the first and second positioning parts partially overlap the winding core part in the third direction.

7. The coil component as claimed in claim 1, wherein each of the first and second flange parts includes a first area whose position in the first direction overlaps the plurality of terminal electrodes and a second area positioned between the first area and the winding core part and whose position in the first direction does not overlap the plurality of terminal electrodes, wherein a step is formed between end portions of the respective first and second areas in the third direction, making the second region be lower in position than the first area in the third direction, and wherein both the first and second positioning parts are formed in the second area.

8. The coil component as claimed in claim 1, wherein the first positioning part is a projection provided on the first flange part, and wherein the second positioning part is a projection provided on the second flange part.

9. The coil component as claimed in claim 1, wherein the first groove extends in the third direction, wherein the second groove extends in the third direction, wherein a width of the first groove in the second direction is greater than a diameter of the first wires thereby a part of the first groove is exposed without covered with the first wire, and wherein a width of the second groove in the second direction is greater than a diameter of the second wires thereby a part of the second groove is exposed without covered with the second wire.

10. The coil component as claimed in claim 1, wherein the first groove extends in the third direction, wherein the second groove extends in the third direction, and wherein a depth of each of the first and second grooves in the first direction is greater than the diameter of each of the first and second wires.

11. A coil component comprising:

a core including a winding core part extending in a first direction and a flange part provided at one end of the winding core part in the first direction;

first and second terminal electrodes provided on the flange part so as to be arranged in a second direction perpendicular to the first direction; and first and second wires wound around the winding core part in an opposite direction from each other, one ends of the first and second wires being connected to the first and second terminal electrodes, respectively, wherein the first terminal electrode does not overlap the winding core part in the second direction, wherein the second terminal electrode overlaps the winding core part in the second direction, wherein the first wire includes a first wound part wound around the winding core part and a first drawn part drawn from the first wound part, running across the winding core part in a third direction perpendicular to the first and second directions and connected to the first terminal electrode, wherein the second wire includes a second wound part wound around the winding core part and a second drawn part drawn from the second wound part, running across the winding core part in the second direction and connected to the second terminal electrode, and wherein the core has a positioning part that positions the first drawn part of the first wire in the second direction, wherein the positioning part is a groove provided in the flange part and having an inner sidewall positioned at the winding core part side and an outer sidewall positioned opposite to the inner sidewall in the second direction, and wherein the drawn part of the first wire contacts a part of the inner sidewall without contacting the outer sidewall.

12. The coil component as claimed in claim 11, wherein the positioning part does not overlap the winding core part in the second direction.

13. The coil component as claimed in claim 12, wherein the groove extends in the third direction.

14. The coil component as claimed in claim 11, wherein the groove extends in the third direction, and wherein a width of the groove in the second direction is greater than a diameter of the first wires thereby a part of the groove is exposed without covered with the first wire.

15. The coil component as claimed in claim 11, wherein the groove extends in the third direction, and wherein a depth of the groove in the first direction is greater than a diameter of the first wire.

16. A coil component comprising:

a core including a winding core part extending in a first direction and a flange part provided at one end of the winding core part in the first direction, the flange part having a first surface extending in the first direction and a second direction perpendicular to the first direction and a second surface extending in the second direction and a third direction perpendicular to the first and second directions and connected to the winding core part;

first and second terminal electrodes provided on the first surface of the flange part so as to be arranged in the second direction; and first and second wires wound around the winding core part in an opposite direction from each other, one ends of the first and second wires being connected to the first and second terminal electrodes, respectively, wherein the first terminal electrode does not overlap the winding core part in the second direction, wherein the second terminal electrode overlaps the winding core part in the second direction, wherein the first wire includes a first wound part wound around the winding core part and a first drawn part drawn from the first wound part, running across the winding core part in the third direction and connected to the first terminal electrode, wherein the second wire includes a second wound part wound around the winding core part and a second drawn part drawn from the second wound part, running across the winding core part in the second direction and connected to the second terminal electrode, wherein the second surface of the flange part has a groove extending in the third direction, wherein the groove has a first section that overlaps the winding core part in the third direction and a second section that does not overlap the winding core part in the third direction, and wherein a part of the first wire is housed in the second section of the groove.

17. The coil component as claimed in claim 16, wherein a width of the groove in the second direction is greater than a diameter of the first wires thereby a part of the groove is exposed without covered with the first wire.

18. The coil component as claimed in claim 16, wherein a depth of the groove in the first direction is greater than a diameter of the first wire.

* * * * *